United States Patent [19]

Kirby, Jr.

[11] 3,994,432

[45] *Nov. 30, 1976

[54] CARTON AND BLANK FOR MAKING SAME

[75] Inventor: Thomas E. Kirby, Jr., Richmond, Va.

[73] Assignee: Reynolds Metals Company, Richmond, Va.

[ * ] Notice: The portion of the term of this patent subsequent to Sept. 20, 1993, has been disclaimed.

[22] Filed: Jan. 16, 1976

[21] Appl. No.: 649,767

Related U.S. Application Data

[63] Continuation of Ser. No. 512,460, Oct. 7, 1974, Pat. No. 3,933,303.

[52] U.S. Cl. ..... 229/52 B; 206/141; 206/427; 229/52 BC

[51] Int. Cl.[2] ..... B65D 5/46

[58] Field of Search ..... 229/52 B, 52 BC, 17 B; 206/141, 142, 161, 427, 430, 170

[56] References Cited

UNITED STATES PATENTS

| | | | |
|---|---|---|---|
| 2,785,847 | 3/1957 | Forrer | 229/52 B |
| 2,838,223 | 6/1958 | Graf | 229/52 BC |
| 2,911,136 | 11/1959 | Stone | 206/427 |
| 3,073,644 | 1/1963 | Baker et al. | 229/52 BC |
| 3,540,581 | 11/1970 | Koolnis | 229/52 B |
| 3,894,681 | 7/1975 | Arneson et al. | 229/17 B |
| 3,933,303 | 1/1976 | Kirby, Jr. | 229/52 B |

FOREIGN PATENTS OR APPLICATIONS

| | | | |
|---|---|---|---|
| 1,464,363 | 1/1966 | France | 229/52 B |

*Primary Examiner*—William Price
*Assistant Examiner*—Bruce H. Bernstein
*Attorney, Agent, or Firm*—Glenn, Palmer, Lyne & Gibbs

[57] ABSTRACT

A carton and blank for making same are provided wherein such carton has a bottom wall, a pair of oppositely arranged side walls foldably connected to the bottom wall, and a top wall defined by a pair of flaps each foldably connected to an associated side wall. The flaps have integral portions defining at least a triple thickness handle for the carton.

4 Claims, 12 Drawing Figures

CARTON AND BLANK FOR MAKING SAME

CROSS-REFERENCE TO RELATED APPLICATION

This is a continuation of applicant's copending application Ser. No. 512,460 filed Oct. 7, 1974, now U.S. Pat. No. 3,933,303.

BACKGROUND OF THE INVENTION

There are so-called "cold pack" cartons for carbonated beverages, and the like, in present use which are made of paperboard and have metallic foil laminated against their outside surfaces. Each of these cartons is used to transport, store, sell, and dispense a predetermined number of beverage containers, usually in the form of metal cans.

Heretofore, these cartons were made primarily utilizing new paperboard which has comparatively long high-strength fibers. However, because of the high cost of wood products and an increasing scarcity of wood and paper products, it has been necessary to make many of these cartons from reclaimed or recycled paper whereby such paper has comparatively short fibers and cartons make therefrom have less structural strength.

It has been found that cartons of the character mentioned, including those made using new paperboard, have integral handles in the top walls thereof which are of marginal strength. Accordingly, it is desirable to provide a high-strength integral handle for a carton of the character mentioned regardless of whether such carton is made of new paperboard, recycled paperboard, or some other material.

SUMMARY

This invention provides an improved carton of the character mentioned and a blank for making same which is of simple and economical construction; and, such carton comprises a bottom wall, a pair of oppositely arranged side walls foldably connected to the bottom wall, and a top wall defined by a pair of flaps each foldably connected to an associated wall, said flaps having means therein defining at least a triple thickness handle for the carton which is substantially coplanar with the top wall.

Other details, uses, and advantages of this invention will be readily apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
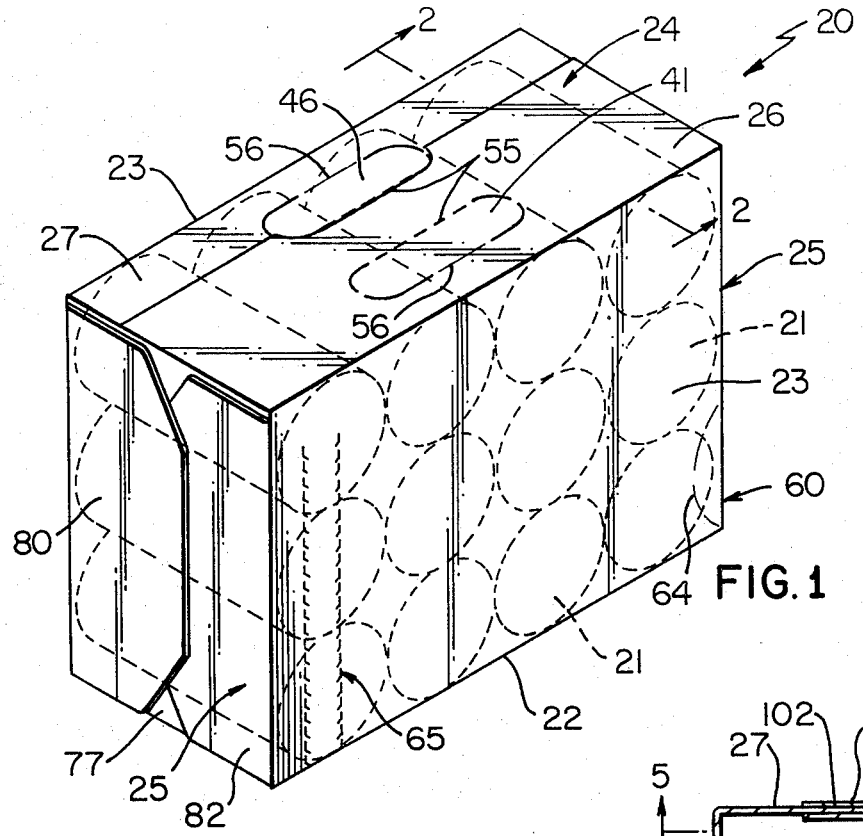
FIG. 1 is a perspective view illustrating one exemplary embodiment of the carton of this invention which has a plurality of articles therein in the form of right cylindrical containers which are shown by dotted lines.
Figure 2:
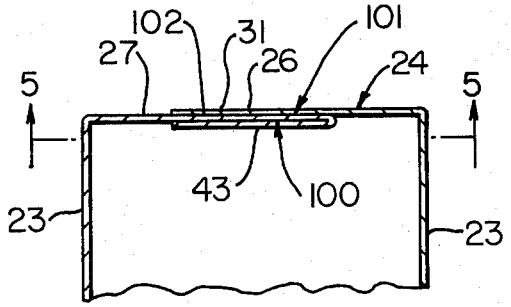
FIG. 2 is a fragmentary cross-sectional view taken essentially on the line 2—2 of FIG. 1.

Reference is now made to FIG. 1 of the drawings which illustrates one exemplary embodiment of the carton 20 of this invention which is particularly adapated to be used in storing, carrying, and dispensing a predetermined number of articles, such as right circular cylindrical containers which may be in the form of cans 21, each containing a carbonated beverage, or the like. Accordingly, the exemplary carton 20 is in the form of a so-called "cold pack" carton. The carton 20 comprises a bottom wall 22, a pair of oppositely arranged side walls, each designated by the same reference numeral 23, a top wall 24, and a pair of oppositely arranged end walls, each designated by the same reference numeral 25. As seen particularly in FIGS. 6 and 7 of the drawings, the top wall 24 is defined by a pair of flaps 26 and 27 each foldably connected to an associated wall and the flaps 26 and 27 have means 30 therein, which will be described in detail subsequently, defining at least an integral triple thickness handle 31 for the carton which is preferably arranged substantially coplanar with the top wall 24.

Figure 6:
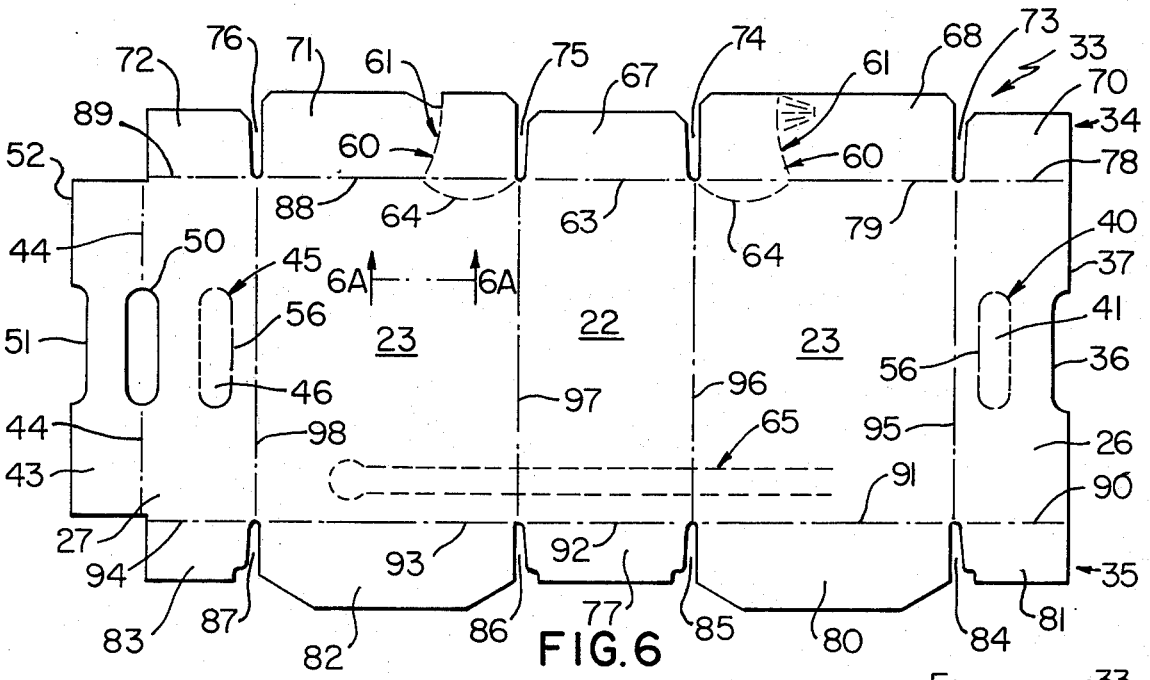
FIG. 6 is a plan view of a typical blank which may be used to define the carton of FIG. 1.

Referring now to FIG. 6 of the drawings which illustrates a blank which is designated generally by the reference numeral 33 and is used to make the carton 20, it will be seen that the bottom wall 22, side walls 23, and flaps 26–27 have a first set 34 of end flaps extending from one end thereof and a second set 35 of end flaps extending from the opposite end thereof. In the carton so defined from blank 33, the first set 34 of end flaps cooperate to define one end wall 25 of the carton 20 and the second set 35 of end flaps cooperate to define the other end wall 25 of such carton. Thus, once the bottom wall 22, side walls 23, flaps 26–27, and sets 34 and 35 of end flaps are suitably arranged and bonded or fixed together they define the carton 20 which is the form of a rectangular parallelopiped.

Figure 3:
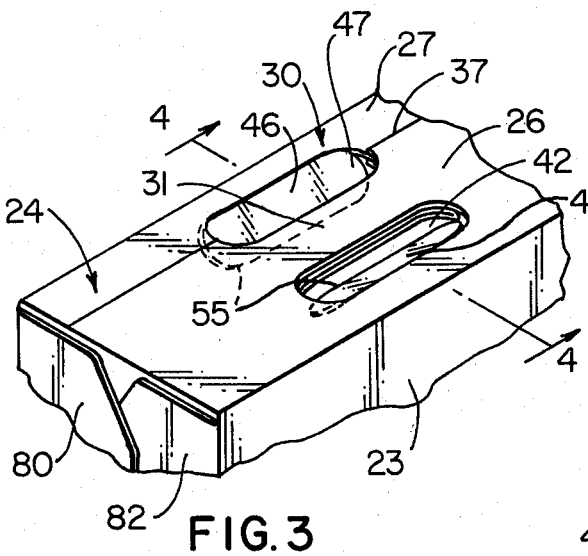
FIG. 3 is a fragmentary perspective view illustrating the upper portion of the carton of FIG. 1 minus its containers and with tabs in its top wall pushed within the carton to define handle means and facilitate easy grasping of such carton for carrying purposes.
Figure 7:
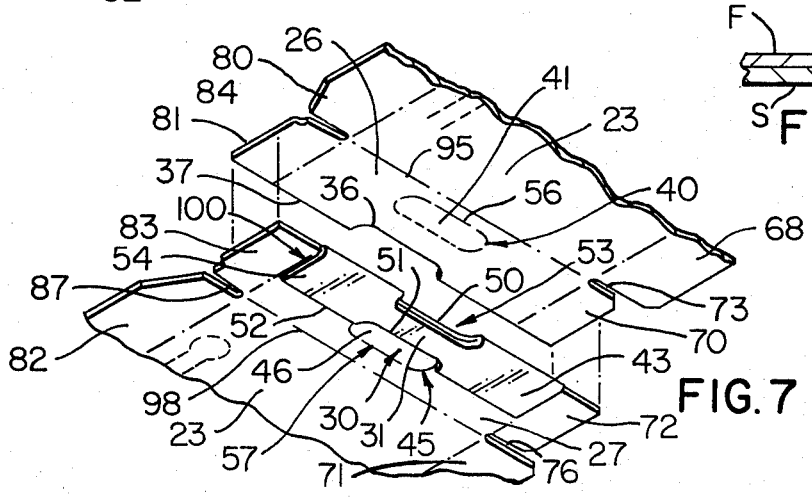
FIG. 7 is a fragmentary perspective view illustrating the manner in which flaps which are foldably connected to the side walls of the carton of FIG. 1 may be positioned and bonded together to define the top wall of such carton.

As seen in FIGS. 6 and 7, the means 30 defining at least a triple thickness handle 31 comprises one flap, shown as flap 26, having a first cutout therein which will be referred to as a first half slot 36 and is defined in its outermost or terminal edge 37 and slit means designated generally by the reference numeral 40 defining a first foldable tab 41 and a first full slot 42 upon opening such tab as shown in FIG. 3. The other flap 27 has an extension 43 foldably connected thereto along a weakened rectilinear line 44, defined by two spaced portions, which may be in the form of score lines, and the flap 27 has slit means 45 defining a second foldable tab 46 and a second full slot 47 when such tab is opened, as illustrated in FIG. 3. The flap 27 also has a third full slot 50 therein which is open and centered about an axis defined by the weakened line 44.

The extension 43 has a second half slot 51 in its outermost or terminal edge 52 and the extension is folded along the weakened line 44 to bifold the full slot 50 as illustrated at 53 in FIG. 7 and the extension 43 is fixed against the base portion of the flap 27 and is dimensioned such that its half slot 51 adjoins and is aligned with the slit means 45 to define a double thickness construction 54 with such slit means 45 being arranged in aligned relation with the bifolded open slot 50 as shown at 57. The flap 26 is laminated against the double thickness construction 54 to define the triple thickness handle 31 upon severing the slit means 40 and 45 and pushing the respective tabs 41 and 46 within the carton.

As will be apparent particularly from FIGS. 1, 3, 6, and 7 the slit means 40 and 45 are defined in their respective flaps 26 and 27 enabling each of the associated tabs 41 and 46 to be hingedly fastened to its flap so that the swinging end of each tab, designated in each instance by the reference numeral 55, moves away from the central portion of the carton 20. Each of the tabs 41 and 46 is defined as an integral part of its flap and each has means hingedly fastening such tab to its associated flap; and, in this example a weakened line in the form of a score line 56 is provided hingedly fastening tab 41 to the flap 26 and a score line also designated 56 is provided hingedly fastening the tab 46 to the flap 27.

As seen particularly in FIG. 1 of the drawings, the carton 20 has means designated generally by the reference numeral 60 defining a hinged door and a dispensing opening for the articles or containers 21 within the carton 20; and, such means 60 comprises cut means 61 extending across the entire width of an end wall, the right end wall as viewed in FIG. 1, and such cut means comprises a plurality of cuts which extend completely through the end wall material and are arranged in substantially end to end relation adjoined by comparatively short lengths of uncut or unsevered wall material. The means 60 includes a score line 63 which serves as a hinge and is arranged in spaced relation from the cut means 61 and the means 60 also includes cut means 64 in each of the side walls 23 defined similar to cut means 61. Each cut means 64 is arranged in an arcuate path and adjoining associated ends of the score line 63 and the cut means 61. Thus, upon severing along the cut means 61 and 64 a hinged dispensing door is defined having the score line 63 as its hinge.

The carton 20 also has a severable strip 65 therein defined adjacent one of its ends 25 and the severable strip 65 has a comparatively large circular end which is easily severed and provides a substantial grasping area so that the strip may be severed completely across the bottom wall and across adjoining portions of the side walls 23 whereby practically the entire adjoining end portion of the carton may be torn away to enable rapid removal of the cans 21 from within the carton 20 in the event that it is not desired to dispense such cans through the previously described hinged dispensing door.

Figure 6A:
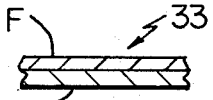
FIG. 6A is an enlarged fragmentary view on the line 6A—6A of FIG. 6.

The carton 20 may be made in any suitable manner and utilizing any suitable foldable material. However, such carton is preferably made from the previously mentioned single piece blank 33 shown in FIG. 6; as seen in FIG. 6A the blank 33 is preferably made of a paperboard structural component or substrate S (whether from new wood products or reclaimed paper), or the like, which has metallic foil F suitably laminated thereto and defining a surface thereof which in the assembled carton 20 is preferably the exposed or outside surface of such carton.

The blank 33 is suitably cut and scored to define the resulting carton 20 upon assembly thereof and the blank 33 has component parts which correspond to the various component parts of the carton 20. Because some of these components parts were described in detail previously in connection with the carton the description thereof will not be repeated. However, it will be noted that in addition to the previously described component portions in the form of the bottom wall 22, side walls 23, and flaps 26 and 27, the blank 33 has the previously mentioned sets 34 and 35 of end flaps which will now be described in detail.

The first set 34 of end flaps is defined by an end flap 67 extending from the bottom wall 22, an end flap 68 extending from one of the side walls 23, an end flap 70 extending from flap 26, an end flap 71 extending from the other side wall 23, and an end flap 72 extending from flap 27. The end flaps comprising the first set 34 have cutouts therebetween defining their sides in the form of a cutout 73 between end flaps 68 and 70, a cutout 74 between end flaps 67 and 68, a cutout 75 between end flaps 67 and 71, and a cutout 76 between end flaps 71 and 72.

The second set 35 of end flaps is defined by an end flap 77 extending from the opposite end of the bottom wall 22, an end flap 80 extending from the side wall 23 having flap 68 at its opposite end, an end flap 81 extending from flap 26, an end flap 82 extending from the other side wall 23, and an end flap 83 extending from the flap 27. The flaps in the second set 35 have cutouts therebetween defining their sides and in the form of a cutout 84 between end flaps 80 and 81, a cutout 85 between end flaps 77 and 80, a cutout 86 between end flaps 77 and 82, and a cutout 87 between end flaps 82 and 83.

The flaps 70, 68, 67, 71, and 72 of the set 34 are suitably foldably connected to their associated walls along score means or fold lines 78, 79, 63, 88, and 89. Similarly, the flaps 81, 80, 77, 82, and 83 of the set 35 are foldably connected to their associated walls along score means or fold lines 90, 91, 92, 93, and 94 respectively.

The blank 33 has a substantially rectangular overall outline and has a plurality of parallel score means or lines 95, 96, 97, and 98 extending between the sides thereof defining its narrow dimension with score line 95 between flap 26 and one side wall 23, score line 96 between such one wall 23 and the bottom wall 22, score line 97 between bottom wall 22 and the other side wall 23, and score line 98 between such other side wall 23 and flap 27.

Figure 4:
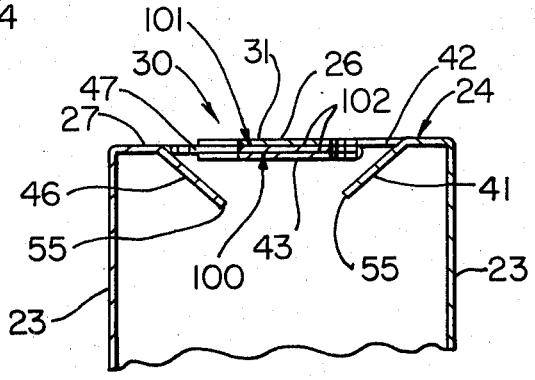
FIG. 4 is a fragmentary cross-sectional view taken essentially on the line 4—4 of FIG. 3.
Figure 5:
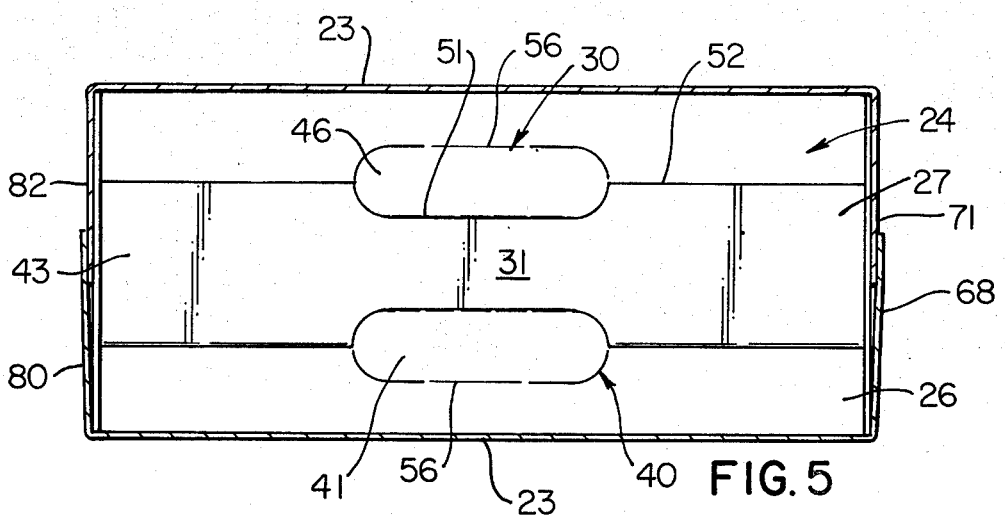
FIG. 5 is a view taken essentially on the line 5—5 of FIG. 2.

As previously mentioned, the blank 33 is preferably a single-piece laminated construction having integral layers of paperboard and metallic foil F. To assure that the handle 31 has optimum strength the extension 43 has its paperboard surface bonded against an associated paperboard surface portion of the base of the flap 27 as illustrated at 100 in FIGS. 4 and 7. Similarly, the flap 26 has its paperboard inside surface bonded against metallic foil as shown at 101 whereby optimum adhesion may be provided due to the fact that at least one paperboard surface has adhesive means or any suiitable adhesive 102, see FIG. 4, bonding it either to another paperboard surface or to a metal foil surface. It has been found that this results in a stronger bond than would be provided if adhesive were to be used between two metal foil surfaces. It should also be noted that the flaps 26–27 and the extension 43 extend the full length of the top wall 24 giving even greater strength to the handle 31.

Figure 10:
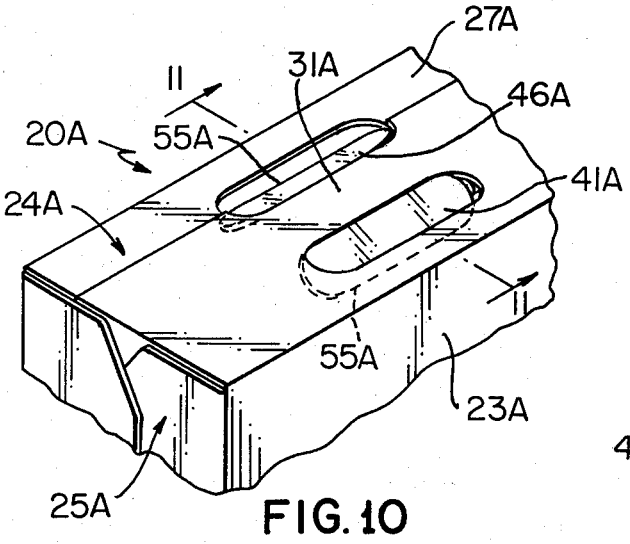
FIG. 10 is a fragmentary perspective view similar to FIG. 3 and illustrating a top portion of the carton defined from the blank of FIG. 8.

Another exemplary embodiment of this invention is illustrated in FIG. 10 of the drawing. The carton illustrated in FIG. 10 is very similar to the carton 20; therefore, such carton will be designated generally by the reference numeral 20A and certain representative parts of the carton 20A which are very similar to corresponding parts of the carton 20 will be designated by the same reference numerals as in the carton 20 also followed by the letter designation A and not described again. Only those component parts of the carton 20A which are different from corresponding parts of the carton 20 will be designated by a new reference numeral also followed by letter designation A and described in more detail.

Figure 8:
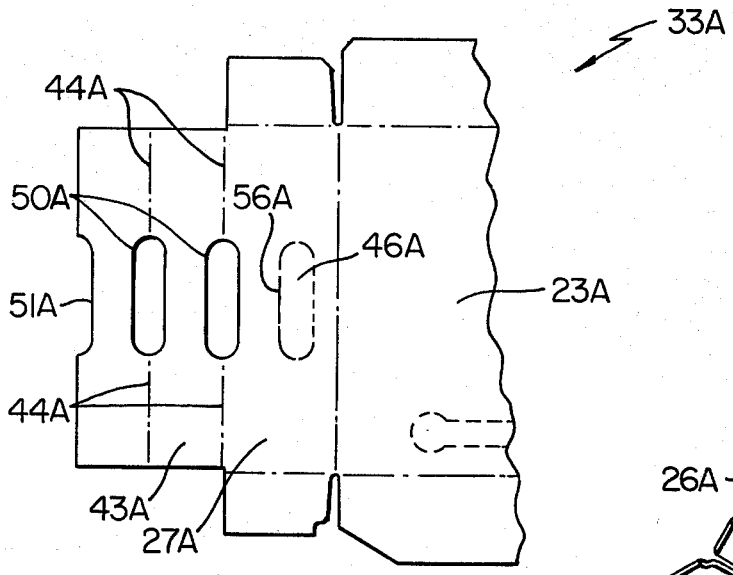
FIG. 8 is a fragmentary plan view of a blank which is identical to the blank of FIG. 6 with the exception of the left-hand portion thereof which has integral means therein enabling forming of a quadruple thickness handle for the carton.

The carton 20A is defined by a blank 33A which is substantially identical to the blank 33 with the exception of the left-hand end portion thereof which is illustrated in FIG. 8 in detail. The blank 33A is suitably cut and scored to define the resulting carton 20A upon assembly thereof and such carton 20A has a quadruple thickness handle 31A.

Figure 9:
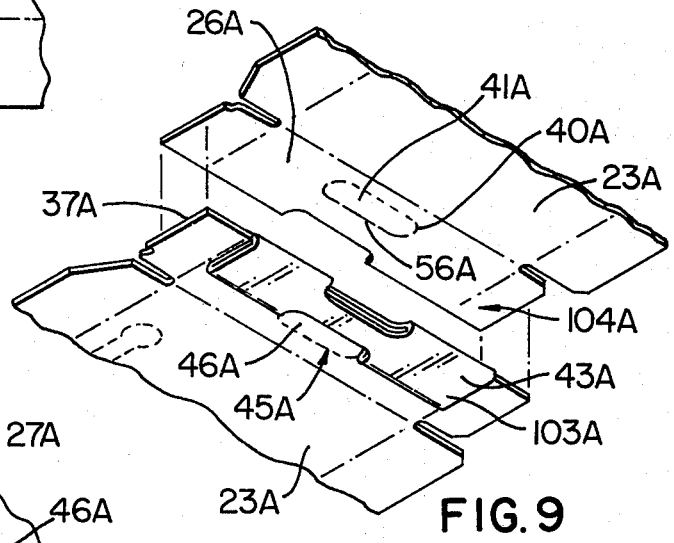
FIG. 9 is a view similar to FIG. 7 illustrating the manner of defining such quadruple thickness handle using the blank of FIG. 8.
Figure 11:
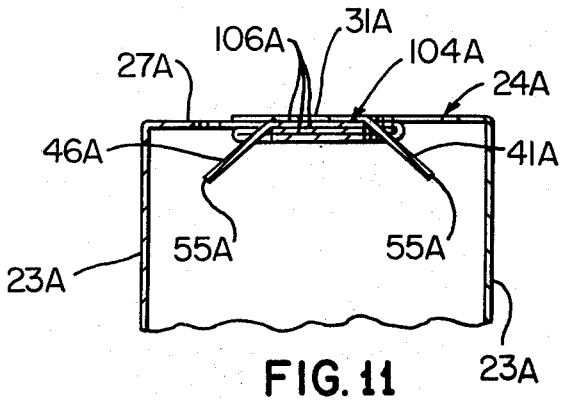
FIG. 11 is a fragmentary cross-sectional view taken essentially on the line 11—11 of FIG. 10.

To provide the quadruple thickness handle the extension flap 27A has an extension 43A of comparatively long length and the extension 43A has a pair of full open slots each designated by the reference numeral 50A and a half slot 51A in its terminal end. Each full open slot 50A is centered about an associated axis 44A and the extension 43A is folded along its weakened lines 44A to bifold each slot 50A and define a triple thickness construction 103A as illustrated in FIG. 9. The folding action is achieved so that each foil surface is bonded to either a paper surface or is an exposed surface and does not require bonding. The foil to paper bond is desirable for similar reasons as discussed previously in connection with the handle 31 of the carton 20. The flap 26A has its paperboard inside surface bonded against metal foil as shown at 104A in FIG. 9 and as seen in FIG. 11 adhesive means in the form of any suitable commercial adhesive 106A is provided at three locations, as shown, to provide the high strength quadruple thickness handle means or handle 31A.

The carton 20A and hence the blank 33A used to define such carton has slit means in the form of slit means 40A in the flap 26A and slit means 45A in the flap 27A defined therein to enable the associated tabs 41A and 46A respectively to be hingedly fastened to the associated flap so that the swinging end 55A of each tab moves toward the central portion of the carton 20A. Further, it will be seen that each tab 41A and 46A is hingedly fastened to its associated flap and hence to the top wall 24A defined thereby by hinge means in the form of an associated score line 56A.

Each of the cartons 20 and 20A have their associated tabs, 41 and 46 in the carton 20 and tabs 41A and 46A in the carton 20A, defined by associated slit means and hingedly attached to their associated top wall so that such tabs may be pushed within their carton without obstruction by containers in the carton arranged immediately beneath the top wall to thereby facilitate easy insertion of fingers in the carton, grasping of the associated handle, and carrying of the carton.

In this disclosure each of the tabs 41 and 46 of the carton 20 is shown hingedly fastened to the top wall 24 closely adjacent the side wall which is closer thereto; however, it will be appreciated that such tabs may be hingedly fastened remote from their close side walls, if desired, and similar to the tabs 41A and 46A of carton 20A. The tabs 41A and 46A may likewise be hingedly fastened similar to the tabs 41 and 46.

While present exemplary embodiments of this invention, and methods of practicing the same, have been illustrated and described, it will be recognized that this invention may be otherwise variously embodied and practiced within the scope of the following claims.

What is claimed is:

1. A carton comprising, a bottom wall, a pair of oppositely arranged side walls foldably connected to said bottom wall, and a top wall defined by a pair of flaps each foldably connected to an associated side wall, said flaps having means defining at least a triple thickness handle in said top wall for said carton, said means defining said handle comprising, one of said flaps having first means defining a first foldable tab and a first full slot, and the other of said flaps having an extension foldably connected along a weakened line, said other flap having second means defining a second foldable tab and a second full slot, said extension being folded along said weakened line and being dimensioned and fixed against the base portion of its flap to define a double thickness construction, said one flap being laminated against said double thickness construction to define said triple thickness handle upon severing said first and second means and pushing their associated tabs within said carton, said one flap and double thickness construction being disposed flatly against each other and define said triple thickness handle which is substantially coplanar with said top wall.

2. A carton as set forth in claim 1 in which said extension extends across the full dimension of said other flap.

3. A carton as set forth in claim 2 in which said first and second means comprise first and second slit means.

4. A blank which is suitably cut and scored to define a resulting carton upon assembly thereof; said blank comprising, a bottom wall, a pair of oppositely arranged side walls foldably connected to said bottom wall, and a pair of flaps each foldably connected to an associated side wall and defining a top wall in said resulting carton, one of said flaps having first means defining a first foldable tab and a first full slot, and the other of said flaps having an extension foldably connected along a weakened line, said other flap having second means defining a second foldable tab and a second full slot, said extension being adapted to be folded along said weakened line and being dimensioned and adapted to be fixed against the base portion of its flap to define a double thickness construction, said one flap being laminated against said double thickness construction in said resulting carton to define a triple thickness handle upon severing said first and second means and pushing their associated tabs within said resulting carton, said one flap and double thickness construction being disposed flatly against each other and define said triple thickness handle which is substantially coplanar with said top wall of said resulting carton; said resulting carton being particularly adapted to contain a plurality of substantially identical right circular cylindrical containers, and further being arranged to facilitate the receipt of fingers between sides of such of said containers as may be positioned immediately beneath said top wall.

* * * * *